United States Patent [19]

Moffitt et al.

[11] 4,223,294

[45] Sep. 16, 1980

[54] VERNIER CONTROL

[75] Inventors: Jerry T. Moffitt, Muskego; Robert W. Bulgrin, Ft. Atkinson, both of Wis.

[73] Assignee: Allen-Bradley Company, Milwaukee, Wis.

[21] Appl. No.: 951,769

[22] Filed: Oct. 16, 1978

[51] Int. Cl.[2] ..... H01C 10/18

[52] U.S. Cl. ..... 338/122; 338/123

[58] Field of Search ..... 338/122, 123, 128–131, 338/174, 181, 202, 184, 199; 29/610

[56] References Cited

U.S. PATENT DOCUMENTS

| | | | |
|---|---|---|---|
| 2,873,336 | 2/1959 | Tassara | 338/174 X |
| 3,564,476 | 2/1971 | Barden | 338/128 X |
| 3,597,717 | 8/1971 | Kent | 338/131 |
| 3,676,822 | 7/1972 | Slagg et al. | 338/128 X |
| 3,898,606 | 8/1975 | Dumas et al. | 338/174 X |
| 4,050,050 | 9/1977 | Nakanishi et al. | 338/128 X |
| 4,075,597 | 2/1978 | Peart | 338/128 |

FOREIGN PATENT DOCUMENTS

| | | | |
|---|---|---|---|
| 886488 | 1/1962 | United Kingdom | 338/174 |

*Primary Examiner*—C. L. Albritton

*Attorney, Agent, or Firm*—Quarles & Brady

[57] ABSTRACT

A vernier control (10) with independent coarse and fine adjustments includes a track pattern (17) that is formed along three concentric rings on a single base (11). A horseshoe-shaped, low-resistance track (17*a*) extends around a segment of the inner ring and has a pair of termination tracks (17*d*, 17*e*) connected to its opposite ends and extending in reverse directions in opposite half-sections of the intermediate ring. A pair of high-resistance tracks (17*b*, 17*c*) are formed in opposite half-sections of the outer ring, each extending alongside a respective termination track (17*d*, 17*e*). A fine adjustment rotor (16) is journaled in the base (11) in the center of the track pattern (17), and carries a fine adjustment contact (15) that engages both a collector terminal (19) on the base (11) and the low-resistance track (17*a*). An annular contact carrier (12) is mounted for rotation around the rotor (16) and carries a pair of coarse adjustment contacts (13). Each coarse adjustment contact (13) electrically connects one of the termination tracks (17*d*, 17*e*) to its adjacent high-resistance track (17*b*, 17*c*). A control of this type may be employed in television sets for brightness, color and contrast adjustments.

8 Claims, 8 Drawing Figures

VERNIER CONTROL

TECHNICAL FIELD

The invention relates to variable resistor controls which can be employed as either potentiometers or rheostats, and more particularly, to a vernier control having both coarse and fine adjustments for varying the portion of its resistance that is connected in an electrical circuit.

BACKGROUND ART

Vernier controls, as referred to herein, are those controls which provide both coarse and fine adjustments. Several types of vernier controls are known in the art. One type includes a variable resistor having a circular resistance track and a conductive brush that is coupled to inner and outer concentric operating shafts. These shafts rotate to move the brush along the resistance track to vary the resistance between the brush and the ends of the track. The outer shaft is coupled to the brush through a gear reduction module to provide a fine adjustment, and the inner shaft is coupled directly to the brush to provide a coarse adjustment. In this type of control the coarse and fine adjustments are coupled together through the gear reduction module so that the operation of one shaft will result in the turning of the other shaft as well. Such a control is disclosed in Slagg et al., U.S. Pat. No. 3,676,822, issued July 11, 1972.

In Peart, U.S. Pat. No. 4,075,597, issued Feb. 21, 1978, a control is disclosed for selectively coupling a single operating shaft to a single resistance track, which is disposed on a substrate, through a pair of alternately operable drive gears spaced along the longitudinal axis of the operating shaft. A contact-carrying rotor is mounted on the substrate, and has gear teeth for engaging whichever drive gear is operated. This patent also discloses a two-resistor module having a pair of these controls disposed side by side in a housing with their respective substrates spaced apart and substantially parallel to one another.

Another type of control that provides both coarse and fine adjustments includes two variable resistors spaced axially along a single operating shaft that is coupled to both resistors. At least two different controls belong to this category. One of these controls relies on a phenomenon known as "backlash." Backlash is a degree of looseness or play in a mechanical coupling mechanism that allows a drive shaft to be turned a rotational distance before it drives a mechanical output member. A control that employs backlash has front and rear potentiometers. The rear potentiometer has an arcuate resistance track with a higher resistance value than an arcuate resistance track included in the front potentiometer, usually by ratio of about 10:1. The low resistance potentiometer has a brush which rides along its resistance track and is directly coupled to an operating shaft. The high resistance potentiometer has a brush which rides along its resistance track, but is coupled to the operating shaft through a backlash coupling mechanism. The brush in the rear potentiometer will be allowed to "idle" while the operating shaft is rotated to move the brush in the front potentiometer along its resistance track for a fine adjustment. The mechanical independence of the brush in the front potentiometer can be 40°, for example, before the brush in the rear potentiometer is picked up by the shaft and moved for a coarse adjustment.

Another vernier control in which a single shaft is coupled to two variable resistors also has front and rear resistive elements formed in annular tracks and spaced axially along a concentric operating shaft. The rear element has a high resistance value for coarse adjustment and the front resistance element has a low resistance value for fine adjustment. The operating shaft is normally positioned for operation of the front potentiometer for fine adjustment. The operating shaft is also coupled, however, to the rear potentiometer through a vernier clutch drive. The operating shaft can be depressed, which decouples it from the front potentiometer, and allows it to be coupled to the rear potentiometer for coarse adjustment.

Multiple adjustment controls are used in, among other things, color television sets, for brightness, color and contrast adjustments. In this application it is desirable to have a coarse adjustment which is set by a trained technician at a factory or service center, and which is not easily accessible to the user, and a fine adjustment which can be operated by the user. The controls described above do not provide this capability because the coarse and fine adjustments are equally accessible, being controlled by a pair of concentric shafts or by a single shaft.

In the field of electrical controls there is a continual demand for components which are smaller in size, and less expensive. A vernier control that does not need a vernier drive, and that employs a single module instead of a pair of potentiometer modules will produce economic advantages in manufacturing that are deemed apparent.

DISCLOSURE OF THE INVENTION

The invention resides in a variable resistor control having two independently adjustable variable resistors with respective resistance tracks that are electrically connected together and disposed on a common base.

The first variable resistor is formed by a first resistance track disposed on the base, a first movable contact engaging the first resistance track, and a first adjustment means for positioning the first movable contact at various points of engagement along the first resistance track, to vary the resistance between the first movable contact and the ends of the first resistance track.

The second variable resistor has a second resistance track disposed on the base and spaced apart from the first resistance track to form a gap. The second resistance track is electrically connected to the first resistance track through a termination track connected to one end of the first resistance track and extending into the gap between the resistance tracks, and through a second movable contact having a pair of engagement surfaces. One engagement surface contacts the terminal track and another engagement surface contacts the second resistance track. The second movable contact is carried by a second adjustment means which is operable for variably positioning the second movable contact along these two tracks, to vary the position of the second resistance track that is electrically connected to the first resistance track. Retaining means connected to the base are provided to hold the second adjustment means in its variable operating position.

The invention is of particular benefit in constructing a vernier control in which one of the resistance tracks has a higher resistance than the other, usually by some preselected ratio such as 10:1. The adjustment means for positioning the movable contact in engagement with the high-resistance track provides a coarse adjustment, while the adjustment means for positioning the movable contact in engagement with the low-resistance track provides a fine adjustment. The coarse adjustment means can be arranged so that it is not easily accessible when the control is installed in a consumer item such as a television set, while the fine adjustment means can be arranged for easy accessibility.

To obtain a true voltage dividing capability in such a control, a pair of high-resistance tracks can be disposed on the base, and connected by a pair of movable contacts to a pair of termination tracks extending from opposite ends of the low-resistance track. Each of these contacts has one engagement surface contacting a respective termination track and another engagement surface contacting a respective high resistance track. These coarse adjustment contacts are supported for positioning by the coarse adjustment means, which can be a slidable contact carrier.

While the terms "high-resistance track" and "low-resistance track" are used herein to refer to the fact that the "high-resistance track" has a greater resistance than the "low-resistance track," it should be understood that these terms, by themselves, do not refer to any particular ratio in expressing this difference.

One object of the invention is to provide an inexpensive, single-module, variable resistor control with two independent adjustments.

Another object of the invention is to provide a dual adjustment, variable resistor control that is supported on a single base or substrate.

Another object of the invention is to provide a vernier control with both coarse and fine adjustments that does not require mechanical coupling between these two adjustments.

Another object of the invention is to provide a vernier control that is easy to manufacture and assemble.

The foregoing and other objects and advantages of the invention will appear from the following description. In the description reference is made to the accompanying drawings, which form a part hereof, and in which there is shown by way of illustration a preferred embodiment of the invention. Such embodiment does not necessarily represent the full scope of the invention, however, and reference is therefore made to the claims herein for interpreting the scope of the invention.

BEST MODE FOR CARRYING OUT THE INVENTION

Figure 1:
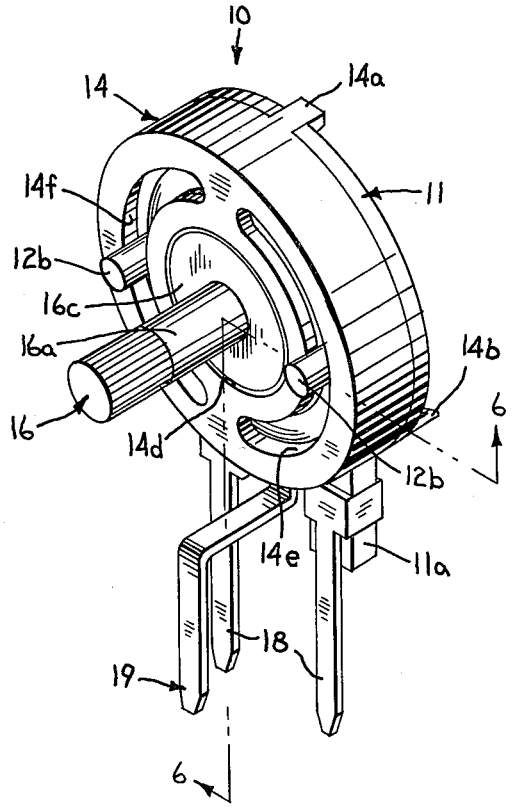
FIG. 1 is a view in perspective of a rotary vernier control that embodies the present invention.

A rotary vernier control 10 that is the preferred embodiment of the invention is shown as an assembled unit in FIG. 1. As see in FIG. 2, the control 10 includes, from back to front, a base 11, a contact carrier 12 with a pair of coarse adjustment contacts 13, a cover 14, a fine adjustment contact 15 and a fine adjustment rotor 16.

Figure 2:
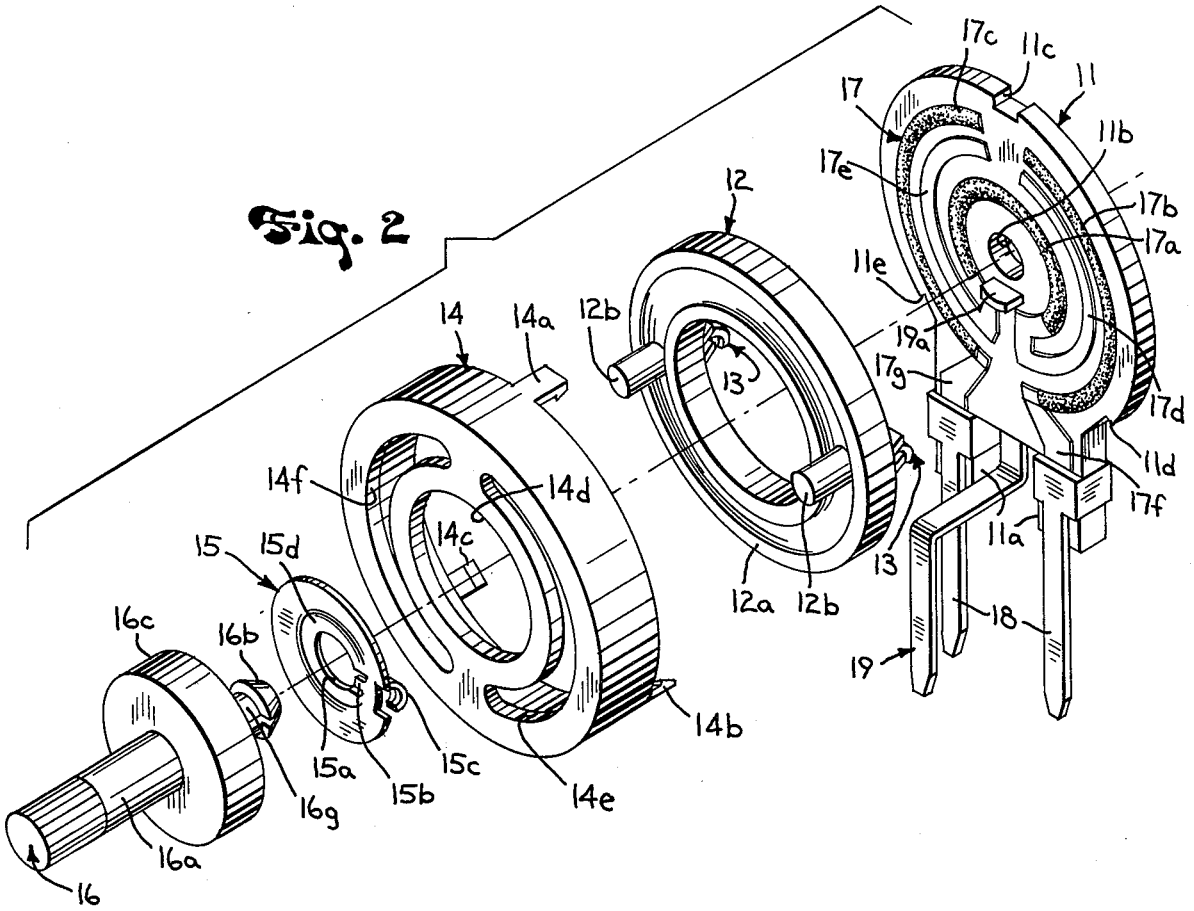
FIG. 2 is an exploded view in perspective of the control of FIG. 1.
Figure 3:
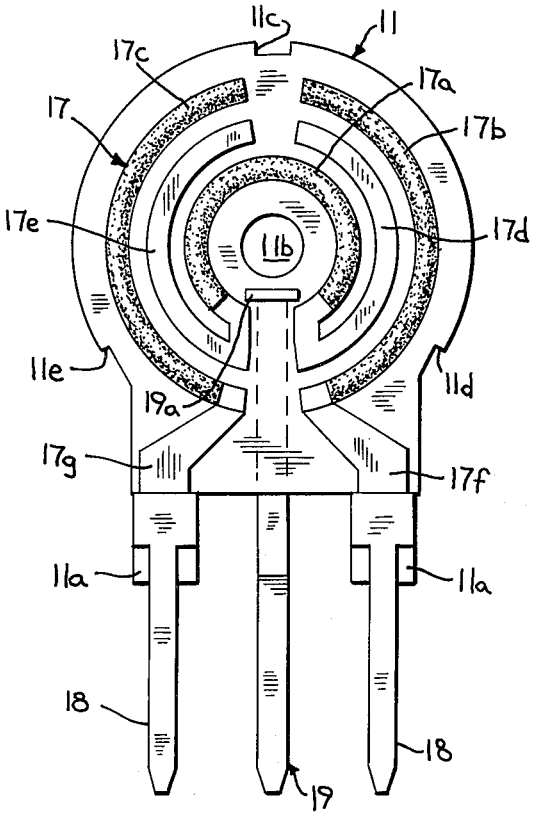
FIG. 3 is a front view in elevation of a base portion of the control of FIG. 1.

As seen in FIGS. 2 and 3, the base 11 has a circular portion, and a portion that depends therefrom with two vertical, depending, spaced-apart legs 11*a*. The circular portion is formed with a central aperture 11*b*, and with three notches 11*c*–11*e* in its outside edge, one notch 11*c* at the top, and the other two notches 11*d*, 11*e* spaced approximately 120° therefrom in opposite directions to adjoin the opposite sides of the depending portion of the base 11.

Figure 6:
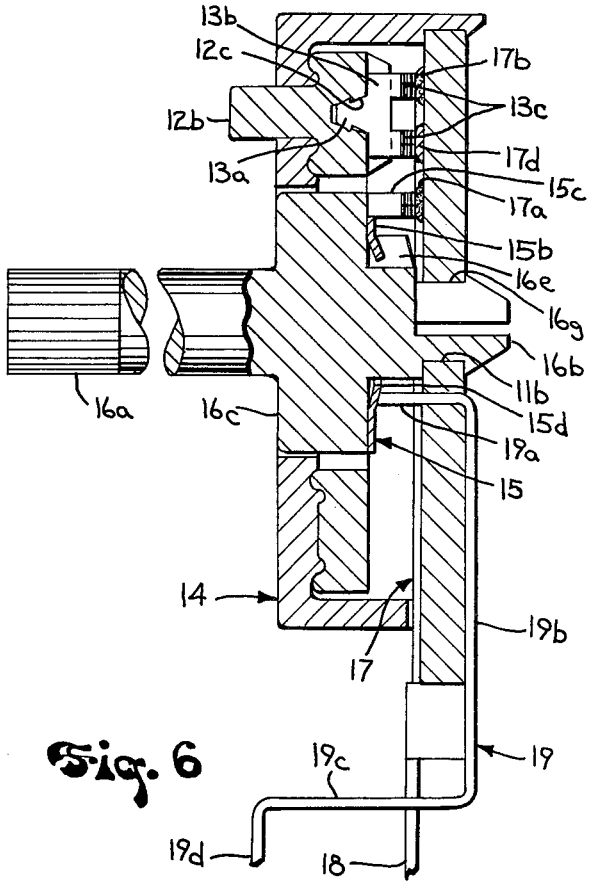
FIG. 6 is a view in cross section taken along lines 6—6 in FIG. 1, with the upper half of the view being rotated 90° counterclockwise from its orientation in FIG. 1.

The base 11, which is formed of an insulating material, has a track pattern 17 formed on its front surface. In FIGS. 2, 3 and 6 the thicknesses of the tracks in this pattern 17 have been exaggerated, and in FIGS. 2 and 3 the resistance tracks have been stippled to aid in disclosing the invention. The track pattern 17 includes a low-resistance track 17*a* that is formed as a horseshoe-shaped, arcuate segment of resistive material, having a gap at its lower extremity between its two ends. This arcuate segment extends approximately 300° around a circular path that is concentric with the central aperture 11*b*. A pair of high-resistance tracks 17*b*, 17*c* are formed on the base 11 as arcuate segments of resistive material. These arcuate segments extend along an outside circular path that is concentric with the inside path followed by the low resistance track 17*a*. The high-resistance tracks 17*b*, 17*c* are separated at the bottom by an extension of the gap between the ends of the low-resistance track 17*a*, and at the top by another gap. Both gaps are formed along a vertical axis of the base 11. The high-resistance tracks 17*b*, 17*c* are thus symmetrical about the vertical axis, forming right and left tracks of equal length and substantially equal resistance. The high-resistance tracks 17*b*, 17*c* are spaced radially from the low-resistance tracks 17*a* to define arcuate side gaps between each of the high-resistance tracks 17*b*, 17*c* and a corresponding portion of the low-resistance track 17*a*. A pair of termination tracks 17*d*, 17*e* of negligible resistance each have an arcuate portion disposed in a respective side gap and extending the length thereof. A substantially vertical portion of each of the termination tracks 17*d*, 17*e* extends upward alongside the gap that separates the ends of the low-resistance track 17*a*, and the lower ends of the high-resistance tracks 17*b*, 17*c*. Each of these vertical portions has an end that is electrically connected to a respective end of the low-resistance track 17*a* by overlaying one end upon the other. A pair of terminal-connecting tracks 17*f*, 17*g* of negligible resistance are connected in the same way to opposite lower ends of the high-resistance tracks 17*b*, 17*c*, and extend downward along the front sides of opposite legs 11*a* of the base 11.

The track pattern 17 can be formed on the base 11 with suitable materials by methods that are well known to those skilled in the art of making resistors. In one suitable construction, the resistance tracks 17a–17c are cermet, with particles of metal and metal oxides suspended in a glass matrix, the termination areas 17d–17g, are also cermet, with particles of a silver powder suspended in a glass matrix for good conduction and negligible resistance, and the base is alumina. The cermet materials are applied in the form of inks, which are then fired on the base 11 individually, or co-fired as a group, in the manner well known in the art. The track pattern 17 can also be formed with screen printing methods and carbon inks on a base 11 made of a suitable thermoplastic polyester resin, as disclosed in Frey, U.S. Pat. No. 4,109,230, issued Aug. 22, 1978, and assigned to the assignee of the present invention. The termination areas 17d–17g can then be formed of conductive plastic as were the conductive members disclosed in a copending application, Ser. No. 850,288, filed Nov. 10, 1977, which is also assigned to the assignee of the present invention. Still other methods and materials known in the manufacture of microcircuits may be employed.

Referring to FIGS. 2, 3 and 6, a pair of metal terminal pins 18 are each mounted on a respective leg 11a with arms at an upper end that wrap around opposite sides of its supporting leg 11a to hold the pin 18 in electrical connection with a respective terminal-connecting track 17f, 17g. A metal, collector terminal pin 19 has a finger 19a that extends through the base 11 from back to front just above the gap between the ends of the low-resistance track 17a and within the area defined by the low-resistance track 17a. The collector pin 19 is bent as it exits from the back side of the base 11 and has an upper shank portion 19b that extends along the back side to a bend below the base 11. From this bend, an offsetting portion 19c of the collector pin 19 extends forward to another bend and to a lower shank portion 19d that extends downward therefrom.

Figure 4:
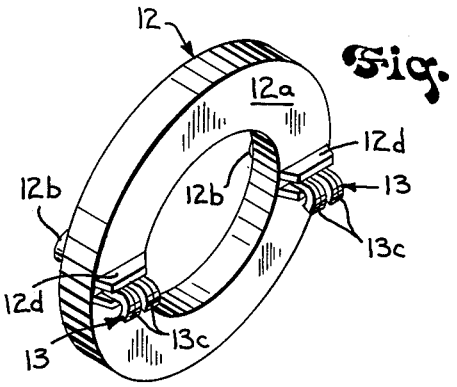
FIG. 4 is a rear view in perspective of a coarse adjustment contact assembly that is seen from the front in FIG. 2.

Referring now to FIGS. 2 and 4, the contact carrier 12 includes a ring member 12a molded from a suitable synthetic insulating material with an annular groove separating inner and outer circular ridges around its front face. A pair of operating stems 12b extend from the bottom of the groove outwardly and substantially perpendicular to the front face of the carrier ring 12a. The operating stems 12b are spaced 180° apart around the carrier ring 12a. On the back of the carrier 12, a pair of coarse adjustment contacts 13 are each held in a tapered slot 12c, as shown in FIG. 6, by a tang 13a that is forced into the slot until it becomes embedded in the insulating material along the sides of the slot 12c. As seen best in FIG. 4, each coarse adjustment contact 13 has a body portion 13b that is held between two trapezoidal retaining barriers 12d on opposite sides of each carrier slot 12c. The coarse adjustment contacts 13 have bifurcated ends, and each bifurcated end further includes a plurality of bent engagement fingers 13c extending outwardly from the body 13b of the contact 13. The coarse adjustment contacts 13 are made of a suitable metal with good conductivity and a resiliency that causes the contact fingers 13c to act as leaf springs in tension, when their tips are pressed into engagement with a contacting surface.

The cover 14 in FIGS. 1 and 2 is a cylindrical frame, molded from a suitable thermoplastic resinous insulating material, with an annular front portion and a skirt portion extending rearward from the edges of the front portion. Extending rearward from the skirt portion are three locking tabs 14a–14c, which are spaced around the back rim of the skirt portion at intervals of 120° to mate with the notches 11c–11e formed in the edge of the base 11. The locking tabs 14a–14c are flexible and slide through the notches 11c–11e. The locking tabs 14a–14c each have a detent on a distal end that fits over the edge of the base 11 to hold the cover 14 in locked engagement therewith. The cover 14 also includes a central aperture 14d, and a pair of arcuate slots 14e, 14f concentrically arranged around the aperture 14d. The arcuate slots 14e–14f are parallel to the tracks in the track pattern 17, and are each disposed to provide an opening over the inside edge of a respective high-resistance track 17b, 17c, and the outside edge of its adjacent termination track 17d, 17e.

With the cover 14 attached to the base 11, as seen in FIG. 6, the contact carrier 12 is held in position with its contacts 13 each having one set of fingers 13c resiliently held against, and sliding along, a respective high-resistance track 17b, 17c, and the other set of fingers 13c similarly contacting the adjacent termination track, 17d, 17e. The cover 14 has a pair of concentric annular grooves around the inside face of its front portion in which the ridges on the front face of the contact carrier ring 12a are received. The carrier stems 12b are received through the arcuate slots 14e, 14f, which guide the stems 12b parallel to their respective high-resistance tracks 17b, 17c. The operating stems 12b are moved to slide the coarse adjustment contacts 13 to the position in which the desired amount of resistance from the high-resistance tracks 17b, 17c is obtained.

Figure 5:
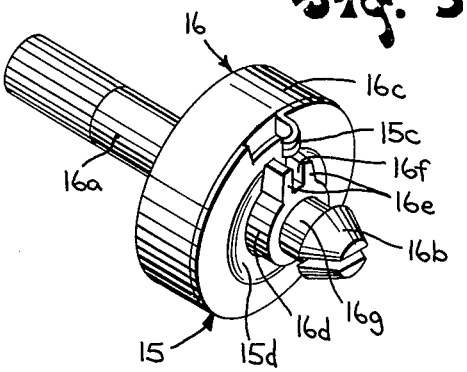
FIG. 5 is a rear view in perspective of a fine adjustment contact assembly that is seen from the front in FIG. 2.

The fine adjustment rotor 16 is formed, as seen in FIGS. 2, 5 and 6, around a cylindrical operating shaft 16a that has a knurl on one end and a slotted, beveled head 16b on its other end. A cylindrical contact carrier 16c of greater diameter than the shaft 16a is formed between the ends of the shaft 16a. Next to an annular contact supporting surface that faces the shaft head 16b, a cylindrical collar 16d is formed around the shaft 16a, and extends axially along the shaft 16a towards the head 16b. A pair of spaced apart tabs 16e extend outwardly from the collar 16d to define a radially extending, rectangular notch 16f therebetween. Between the collar 16d and the wider end of the beveled head 16b, a bearing surface 16g is formed. The rotor 16 is molded from a synthetic, insulating material in this shape for mounting the fine adjustment contact 15.

The fine adjustment contact 15 is an annular metal stamping with a central aperture 15a, and an inside tab 15b formed between two rectangular slots spaced along the inside rim of the contact 15. The tab 15b extends radially inward between the two slots and towards the central aperture 15a. A set of bent contact fingers 15c are formed from an outside tab cut from an outside rim and bent to extend outwardly from the plane of the main portion of the contact 15. The fine adjustment contact 15 is mounted on the rotor contact carrier 16c with the collar 16d being received through its central aperture 15a, and with the inside tab 15b being received in the rectangular notch 16f between the collar tabs 16e, as seen in FIGS. 5 and 6. The fine adjustment contact fingers 15c extend towards the headed end of the shaft 16a. The contact fingers 15c are resilient, so that they can yieldably engage and make electrical contact with the low-resistance track 17a.

The fine adjustment rotor 16 is assembled to the base 11 by forcibly inserting the headed end of the shaft 16a through the central aperture 11b in the base 11. The bearing surface 16g is retained in the base aperture 11b, so that the rotor 16 is journaled in the base 11, as seen in FIG. 6. The rotor contact carrier 16*c* is received in the central aperture of the carrier ring 12*a* and the cover 14 and has clearance for rotation therein. In this arrangement both the fine adjustment rotor 16 and the carrier ring 12*a* rotate about the axis of the rotor shaft 16*a*. The fine adjustment contact fingers 15*c* are radially disposed from the axis of the shaft 16*a* the same distance that the low-resistance track 17*a* is radially disposed from the center of the base aperture 11*b*, so that the fine adjustment contact fingers 15*c* slide along the low-resistance track 17*a* as the rotor shaft 16*a* is rotated. The fine adjustment contact 15 also has an annular, dished-out portion 15*d* encircling its central aperture 15*a*, which bears against the collector finger 19*a* as seen in FIG. 6. The collector finger 19*a* also serves as a stop when either of the collar tabs 16*e* are rotated into contact with it.

Figure 7:
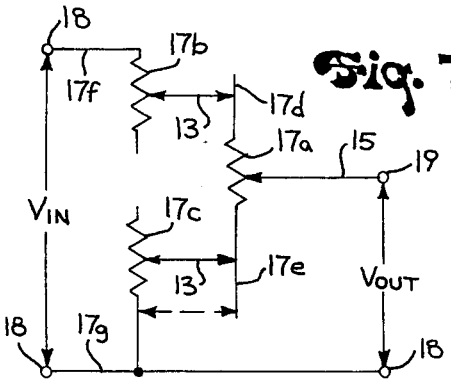
FIG. 7 is an electrical schematic of the control of FIG. 1 when it is used as a voltage-dividing potentiometer.

The electrical result of this mechanical construction is shown in FIG. 7. Using the control 10 as a true voltage-dividing potentiometer, the outside terminals 18 can be connected across an input voltage $V_{in}$. A portion of each high-resistance track 17*b*, 17*c* is connected to an opposite end of the low-resistance track 17*a* through the oppositely disposed coarse adjustment contacts 13. The input voltage $V_{in}$ is then impressed across the preselected portion of the two high-resistance tracks 17*b*, 17*c*, and the low-resistance track 17*a*, where it has been divided by a fine adjustment contact 15 that is electrically connected to the collector terminal 19. The resulting output voltage $V_{out}$ is obtained between the collector terminal 19 and one of the other terminals 18 that is common to the input and output sides of the device.

Figure 8:
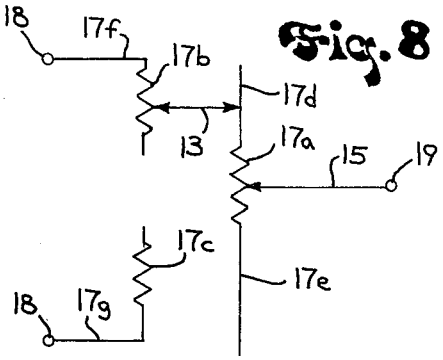
FIG. 8 is an electrical schematic diagram of the control of FIG. 1, when it is employed as a rheostat.

While the coarse adjustment contacts 13 are connected for joint movement in the mechanical illustration in FIGS. 1–6, it should be obvious that they may be independently supported and moved. In fact, only one of the coarse adjustment contacts 13 need be operational to provide both coarse and fine adjustment in a variable resistor control. This mode of operation can be obtained by removing one of the coarse adjustment contacts 13, or merely moving it to a common or ground connection as represented by the phantom position shown in FIG. 7. Although coarse adjustment is provided with a single coarse adjustment contact 13, both coarse adjustment contacts 13 are required for voltage division. The control 10 can also be connected for operation as a rheostat, as shown in the electrical schematic diagram in FIG. 8, by removing one coarse adjustment contact 13, and by connecting the control in series between an input terminal 18 and an output terminal 19. This provides a variable series resistor with both coarse and fine adjustments.

The embodiments of the invention in which an exclusive property or privilege is claimed are defined as follows:

1. A variable resistor control, which comprises:

a base;

a first resistance track disposed on the base;

a first movable contact engaging the first resistance track;

first adjustment means for positioning the first movable contact at various points of engagement along the first resistance track;

a second resistance track disposed on the based and spaced apart from the first resistance track to form a gap;

a termination track disposed in the gap, the termination track having a free end and having another end connected to the first resistance track;

a second movable contact having a pair of engagement surfaces;

second adjustment means for carrying the second movable contact in a position with one engagement surface contacting the termination track and with another engagement surface contacting the second resistance track, the second adjustment means being operable to move the engagement surfaces along their respective tracks to vary the portion of the second resistance track that is electrically connected to the first resistance track; and retaining means connected to the base for holding the second adjustment means in its operating position.

2. The combination of claim 1, wherein one resistance track has a higher resistance than the other resistance track.

3. The combination of claim 1, wherein the first and second resistance tracks and a substantial portion of the termination track are all parallel to one another.

4. The combination of claim 1, wherein the first and second resistance tracks form arcuate segments along inner and outer concentric circular paths, respectively.

5. A variable resistor control for both coarse and fine adjustment, which comprises:

a base;

a low-resistance track and a high-resistance track disposed on the base and spaced apart to form a gap;

a termination track connected to one end of the low-resistance track and extending into the gap;

a coarse adjustment contact having a first engagement with the high-resistance track and a second engagement with the termination track to electrically connect the high-resistance and low-resistance tracks;

a coarse adjustment contact carrier adapted to slidably carry the coarse adjustment contact between the ends of the high-resistance track to vary the portion of the high-resistance track that is connected to the low-resistance track;

retaining means, connected to the base, for mounting the coarse adjustment contact carrier for slidable movement relative to the base;

a fine adjustment contact having an engagement with the low-resistance track; and a fine adjustment shaft movably mounted on the base, the shaft having means thereon for carrying the fine adjustment contact along the low-resistance track as the shaft is moved, to vary the portion of the low-resistance track that is electrically connected to the high-resistance track.

6. The combination of claim 5, wherein:

the low-resistance and high-resistance tracks form arcuate segments along inner and outer concentric circular paths, respectively;

wherein the termination track forms an arcuate segment between the resistance tracks, this arcuate segment being along a circular path that is concentric with the paths of the resistance tracks;

wherein the fine adjustment shaft is rotatably mounted on the base; and wherein the coarse adjustment contact carrier forms a ring around the fine adjustment shaft, and is mounted for rotation about the axis of the fine adjustment shaft.

7. A variable resistor control, which comprises:

a base;

a low-resistance track disposed on the base;

a pair of high-resistance tracks disposed on the base and spaced apart from the low-resistance track to define a gap between each high-resistance track and the low-resistance track;

a pair of termination tracks disposed on the base and extending from opposite ends of the low-resistance track, each termination track extending into a respective gap;

a pair of terminals mounted on the base, each terminal being connected to a respective high-resistance track;

a pair of coarse adjustment contacts, each contact being adapted to engage both a respective high-resistance track and a respective termination track, to electrically connect the low-resistance track between the high-resistance tracks;

a coarse adjustment contact carrier adapted to support the coarse adjustment contacts;

retaining means, connected to the base, for mounting the coarse adjustment contact carrier for sliding movement relative to the base, to allow adjustment of the portions of the high-resistance tracks which are electrically connected to the low-resistance track;

a collector terminal mounted on the base;

a fine adjustment contact adapted to engage both the low-resistance track and the collector terminal; and a fine adjustment shaft adapted to be movably mounted on the base, the shaft having means formed thereon for carrying the fine adjustment contact along the low-resistance track as the shaft is moved, to vary the portion of the low-resistance track that is electrically connected to the high-resistance tracks.

8. The combination of claim 7, wherein:

the low-resistance track and the high-resistance tracks form arcuate segments along inner and outer concentric circular paths, respectively;

wherein each termination track forms an arcuate segment between the low-resistance track and a respective high-resistance track, both termination segments being along a circular path that is concentric with the paths of the resistance tracks;

wherein the fine adjustment shaft is rotatably mounted on the base; and wherein the coarse adjustment contact carrier forms a ring around the fine adjustment shaft, and is rotatable about the axis of the fine adjustment shaft.

* * * * *